US010422526B2

(12) United States Patent
Black et al.

(10) Patent No.: US 10,422,526 B2
(45) Date of Patent: Sep. 24, 2019

(54) WALL-FIRED BURNERS

(71) Applicant: Babcock Power Services, Inc., Worcester, MA (US)

(72) Inventors: Stephen Black, Marlborough, MA (US); Kulbhushan Joshi, Wilmington, MA (US); Max Goodwin, Fitchburg, MA (US); Raymond Legault, Oxford, MA (US)

(73) Assignee: Babcock Power Services, Inc., Marlborough, MA (US)

( * ) Notice: Subject to any disclaimer, the term of this patent is extended or adjusted under 35 U.S.C. 154(b) by 71 days.

(21) Appl. No.: 15/494,727

(22) Filed: Apr. 24, 2017

(65) Prior Publication Data

US 2017/0314780 A1 Nov. 2, 2017

Related U.S. Application Data

(60) Provisional application No. 62/328,478, filed on Apr. 27, 2016.

(51) Int. Cl.
*F23C 1/12* (2006.01)
*F23D 14/24* (2006.01)
(Continued)

(52) U.S. Cl.
CPC ..... *F23D 14/24* (2013.01); *F22G 5/02* (2013.01); *F23C 1/12* (2013.01); *F23D 1/00* (2013.01);
(Continued)

(58) Field of Classification Search
CPC ..... F22G 5/02
(Continued)

(56) References Cited

U.S. PATENT DOCUMENTS 2,608,168 A 8/1952 Jackson
2,649,079 A 8/1953 Van Brunt
(Continued)

FOREIGN PATENT DOCUMENTS

CA 1136924 A 12/1982
CN 203373153 U 1/2014
JP 2007024335 A 2/2007

OTHER PUBLICATIONS

European Communication pursuant to Article 94(3) EPC dated Jul. 6, 2018, issued on corresponding European Patent Application No. 17168206.5 (5 pages).
(Continued)

*Primary Examiner* — Avinash A Savani
(74) *Attorney, Agent, or Firm* — Locke Lord LLP; Joshua L. Jones; Alicia J. Carroll

(57) ABSTRACT

A wall-fired burner includes a fuel tip defining a fuel direction axis and a fuel tip pivot axis perpendicular thereto. A first air tip is adjacent to the fuel tip. The first air tip defines a first air direction axis and a first air tip pivot axis perpendicular thereto. A second air tip is adjacent to the fuel tip, opposite from the first air tip across the fuel tip. The second air tip defines a second air direction axis and a second air tip pivot axis perpendicular thereto. A mechanism operatively connects the fuel tip, the first air tip and the second air tip for at least one of independent and/or joint movement of the fuel tip, the first air tip and the second air tip.

12 Claims, 3 Drawing Sheets

(51) Int. Cl.
*F23D 17/00* (2006.01)
*F22G 5/02* (2006.01)
*F23D 1/00* (2006.01)

(52) U.S. Cl.
CPC ..... *F23D 17/007* (2013.01); *F23D 2201/101* (2013.01)

(58) Field of Classification Search
USPC ..... 431/9; 110/261
See application file for complete search history.

(56) References Cited

U.S. PATENT DOCUMENTS

| | | | | |
|---|---|---|---|---|
| 4,304,196 | A | 12/1981 | Chadshay et al. | |
| 4,434,747 | A | 3/1984 | Chadshay | |
| 5,461,990 | A | 10/1995 | Newman | |
| 2009/0191494 | A1* | 7/2009 | Galfrascoli | F23N 5/082 431/13 |
| 2010/0077942 | A1* | 4/2010 | D'Agostini | F23C 6/04 110/205 |

OTHER PUBLICATIONS

Extended European Search Report dated Oct. 10, 2017, issued during the prosecution of corresponding European Patent Application No. EP 17168206.5 (10 pages).

* cited by examiner

WALL-FIRED BURNERS

CROSS-REFERENCE TO RELATED APPLICATIONS

This application claims the benefit of priority under 35 U.S.C. § 119(e) to U.S. Provisional Application No. 62/328,478, filed Apr. 27, 2016, the content of which is incorporated herein by reference in its entirety.

BACKGROUND OF THE INVENTION

1. Field of the Invention

The present disclosure relates to wall-fired burners, and more particularly to wall-fired burners for furnaces in steam generation plants.

2. Description of Related Art

Wall-fired burners are used in the furnaces for steam generation plants, such as coal, oil, and/or natural gas combination fired applications. In some cases, the primary fuel can be coal and the secondary fuel can be natural gas. Typically, in single-fuel steam generation plants, wall-fired burners direct air and fuel perpendicularly outward from the furnace wall.

Such conventional methods and systems have generally been considered satisfactory for their intended purpose. However, there is still a need in the art for improved wall-fired boilers, specifically those used in multiple-fuel systems. The present disclosure provides a solution for this need.

SUMMARY OF THE INVENTION

A wall-fired burner includes a fuel tip defining a fuel direction axis and a fuel tip pivot axis perpendicular thereto. A first air tip is adjacent to the fuel tip. The first air tip defines a first air direction axis and a first air tip pivot axis perpendicular thereto. A second air tip is adjacent to the fuel tip, opposite from the first air tip across the fuel tip. The second air tip defines a second air direction axis and a second air tip pivot axis perpendicular thereto. A mechanism operatively connects the fuel tip, the first air tip and the second air tip for at least one of independent and/or joint movement of the fuel tip, the first air tip and the second air tip.

The mechanism can be a bar linkage that operatively connects the fuel tip, the first air tip and the second air tip for joint rotation about their respective pivot axes to adjust the direction of the respective direction axes. The wall-fired burner can include a drive arm having a first end operatively connected to at least one of the fuel tip, the first air tip or the second air tip to drive rotation of the fuel tip, the first air tip and the second air tip about the respective pivot axes. The wall-fired burner can include a rotating drive and an arm connector attached to the rotating drive. The arm connector can have a first end attached to the rotating drive and a second end attached to a second end of the drive arm. The fuel tip can be at least one of a coal or natural gas fuel tip. An igniter can be positioned adjacent to an exit of the fuel tip, between the exit of the fuel tip and an exit of one of the first or second air tips. A flame scanner can be positioned adjacent to an exit of the fuel tip. The wall-fired burner can include a first side wall and a second side wall, wherein the first and second side walls are opposite from one another across the fuel tip and the first and second air tips. The fuel tip and the first and second air tips can be rotatably connected to each of the side walls.

In accordance with another aspect, a method of controlling emissions in a steam generation plant includes issuing a stream of fuel from the fuel tip of the wall-fired burner as described above. The method includes adjusting a direction of the stream of fuel from the fuel tip and airflow the first and second air tips to control steam temperature and to control at least one of NOx, CO and VOC emissions. Adjusting the direction of the stream of fuel and of the airflow can include rotating the fuel tip, the first air tip and the second air tip about respective pivot axes. The method can include biasing at least one of the first and second air tips with respect to a fuel direction axis of the fuel tip to reduce emissions.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
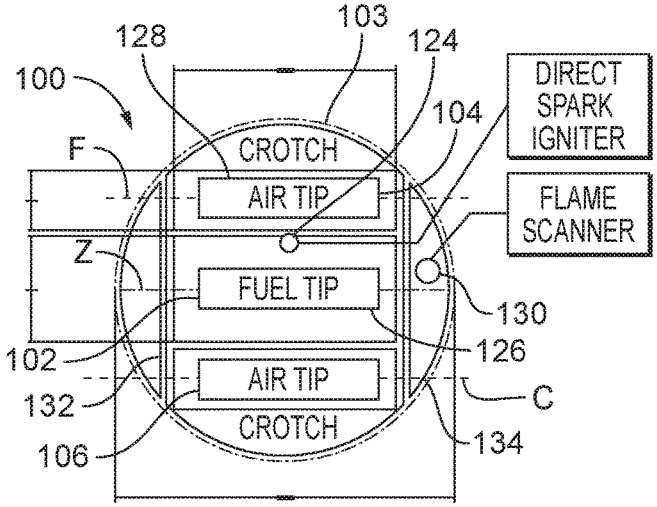
FIG. 1 is a schematic depiction of a wall-fired burner constructed in accordance with an embodiment of the present disclosure, as viewed from inside the furnace.
Figure 2:
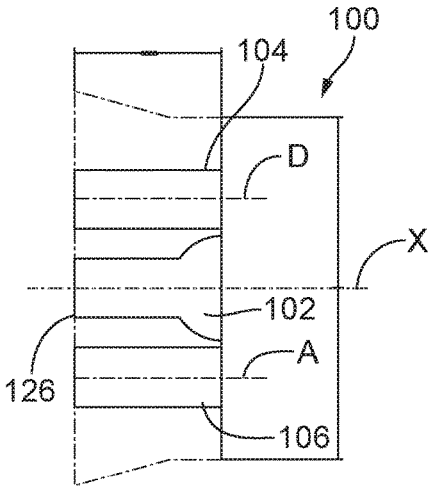
FIG. 2 is a schematic cross-sectional view of the wall-fired burner of FIG. 1, showing the respective direction axes.

Reference will now be made to the drawings wherein like reference numerals identify similar structural features or aspects of the subject disclosure. For purposes of explanation and illustration, and not limitation, a partial view of an exemplary embodiment of a wall-fired burner in accordance with the disclosure is shown in FIG. 1 and is designated generally by reference character 100. Other embodiments of wall-fired burners in accordance with the disclosure, or aspects thereof, are provided in FIGS. 2-9, as will be described. Additional drawings without reference characters, also labeled FIGS. 1-9, are being included for clarity. The systems and methods described herein can be used to control steam temperature and control at least one of NOx, CO and VOC emissions.

As shown in FIG. 1, a wall-fired burner 100 is a tilting wall-fired gas burner 100. Wall-fired gas burner 100 includes three tips to control the steam temperature produced by burning gas, e.g. natural gas, in wall-fired type boilers and stoker type boilers with wall-fired burners above the stoker. A fuel tip 102 is located in the middle of two air tips 104 and 106, e.g. combustion air tips. A first air tip 104 is located above the fuel tip 102 and a second air tip 106 is located below fuel tip 102, opposite from first air tip 104 across fuel tip 102. Tips 102, 104 and 106 are positioned in an opening 103 of a furnace wall. Those skilled in the art will readily appreciate that fuel tip 102 can be a coal or natural gas fuel tip 102. Wall-fired gas burner 100 provides extended steam generation capacity and reduced maintenance requirements as compared to traditional non-tilting wall-fired burners.

With continued reference to FIG. 1, an igniter 124 is positioned adjacent to an exit 126 of fuel tip 102, between exit 126 of fuel tip 102 and an exit 128 of first air tip 104. A flame scanner 130 is positioned adjacent to exit 126 of fuel tip 102. Wall-fired gas burner 100 includes a first side wall 132 and a second side wall 134. First and second side walls 132 and 134 are opposite from one another across fuel tip 102 and first and second air tips 104 and 106. First and second side walls 132 and 134 are provide linear surfaces on which to mount tips 102, 104 and 106. This can be helpful in retro-fit applications where the current openings in the furnace walls are circular or non-rectangular. Where rectangular holes are present, side walls 132 and 134 may not be necessary.

Figure 3:
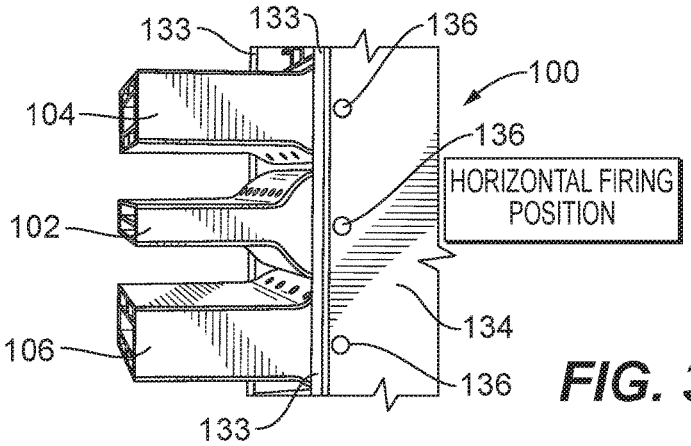
FIG. 3 is a schematic depiction of a side perspective view of the wall-fired burner of FIG. 1, showing the respective directions of each of the tips in a horizontal firing position.

With reference now to FIGS. 1-4, fuel tip 102 and first and second air tips 104 and 106 are rotatably connected to each of side walls 132 and 134 with a pivot pin 136, for example, or other suitable fastener. Fuel tip 102 defines a fuel direction axis X and a fuel tip 102 pivot axis Z perpendicular thereto. First air tip 104 defines a first air direction axis D and a first air tip 104 pivot axis F perpendicular thereto. Second air tip 106 defines a second air direction axis A and a second air tip 106 pivot axis C perpendicular thereto. As shown in FIG. 3, a horizontal position means that the fuel direction axis X is perpendicular to the furnace wall and/or a side surface 133 of side walls 132 and 134.

Figure 4:
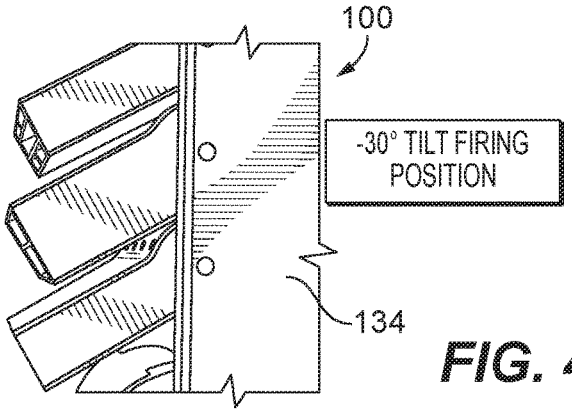
FIG. 4 is a schematic depiction of a side view of the wall-fired burner of FIG. 1, showing the respective directions of each of the tips in a −30 degree tilt firing position.
Figure 8:
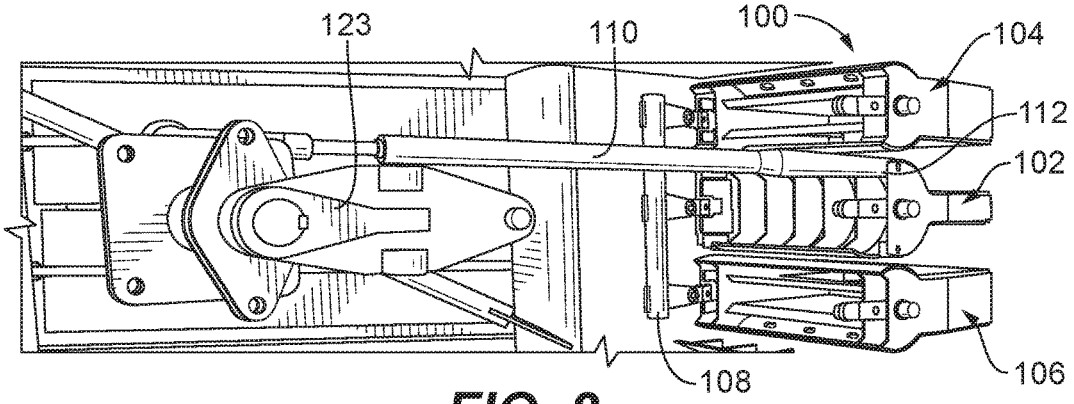
FIG. 8 is a schematic depiction of a perspective view of the wall-fired burner of FIG. 1, showing a bar linkage operatively connecting the fuel tip, the first air tip and the second air tip.
Figure 9:
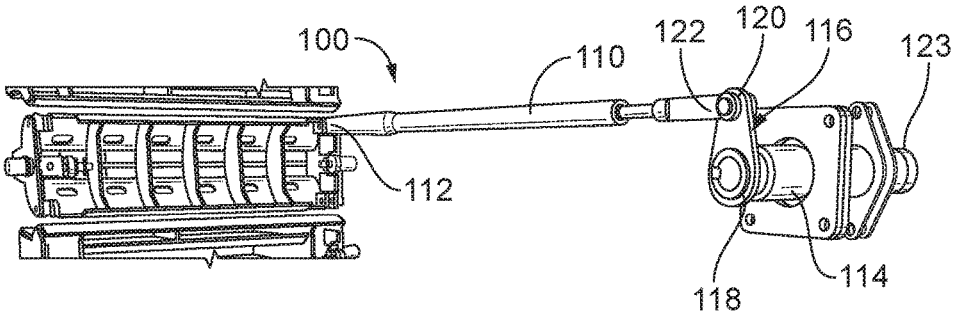
FIG. 9 is a schematic depiction of a perspective view of the wall-fired burner of FIG. 1, showing a drive arm operatively connected to the fuel tip.

As shown in FIGS. 1-4 and 8-9, a mechanism, e.g. a bar linkage 108, operatively connects fuel tip 102, first air tip 104 and second air tip 106 for joint rotation about the respective pivot axes Z, F and C to adjust the direction of the respective direction axes X, D and A. The connection between bar linkage 108, and one or more of the tips (fuel tip 102, first air tip 104, and second air tip 106) can be independently adjusted to bias one or more of the tips as described below. As shown in FIGS. 8-9, a drive arm 110 has a first end 112 operatively connected to fuel tip 102 to drive rotation of fuel tip 102, first air tip 104 and second air tip 106 about the respective pivot axes Z, F and C. A rotating drive 114 is operatively connected to drive arm 110 through an arm connector 116. Arm connector 116 has a first end 118 attached to rotating drive 114 and a second end 120 attached to a second end 122 of drive arm 110. Rotating drive 114 can be rotated by using a tilt adjustment lever 123 attached to rotating drive 114 opposite from arm connector 116. The tilting functionality is provided by individual tips 102, 104 and 106 being linked together with bar linkage 108 to move upwards and downwards from their horizontal position by 30 degrees, or any other suitable range. Tilting of the fuel and air delivery tips downward, as shown in FIG. 4, essentially moves the combustion zone in the furnace below the burner elevation. This will result in longer residence time and heat transfer to the furnace tubes, therefore lowering the furnace exit gas temperature (FEGT).

Those skilled in the art will readily appreciate that lowering the FEGT is particularly advantageous on stoker fired coal boilers where the user is interested in adding/restoring gas firing capability and there is a concern for high steam temperature due to the different combustion characteristics of burning gas. Lowering the FEGT is also advantageous on wall-fired coal boilers that are being converted to firing natural gas, which will result in changing steam temperature due to the different combustion characteristics firing gas, existing wall-fired gas boilers that have steam temperature control issues, and existing wall-fired gas boilers that are undergoing modifications that will affect its ability to control steam temperature (e.g. addition of flue gas recirculation to control NOx emissions will increase the steam temperature).

Figure 5:
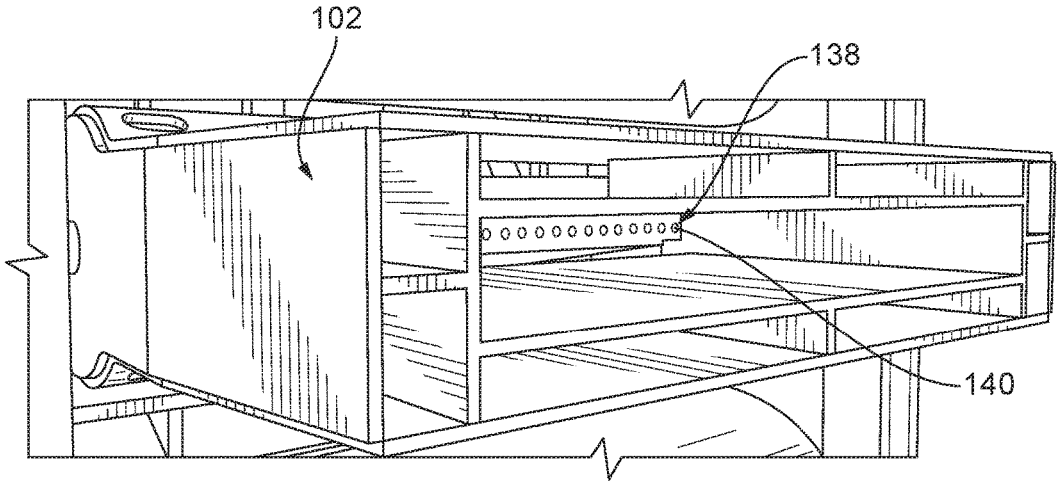
FIG. 5 is a schematic depiction of a perspective view of a fuel tip of the wall-fired burner of FIG. 1, showing the gas spud of the fuel tip with a plurality of fuel orifices.
Figure 6:
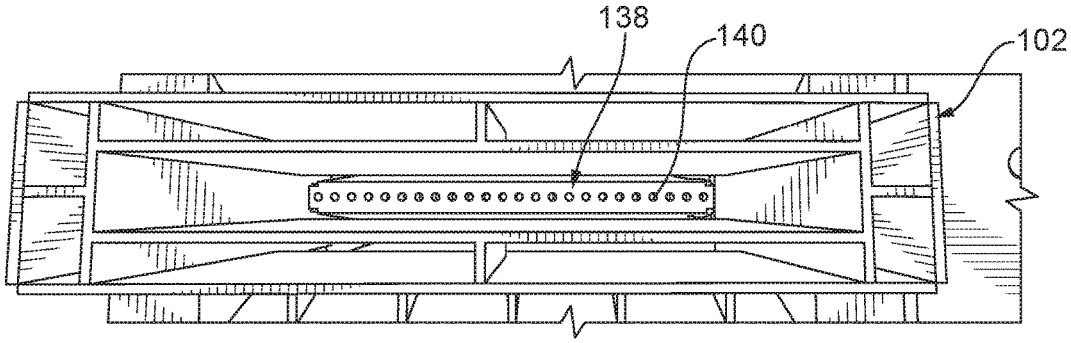
FIG. 6 is a schematic depiction of a front view of a fuel tip of the wall-fired burner of FIG. 1, showing the gas spud of the fuel tip with a plurality of fuel orifices.
Figure 7:
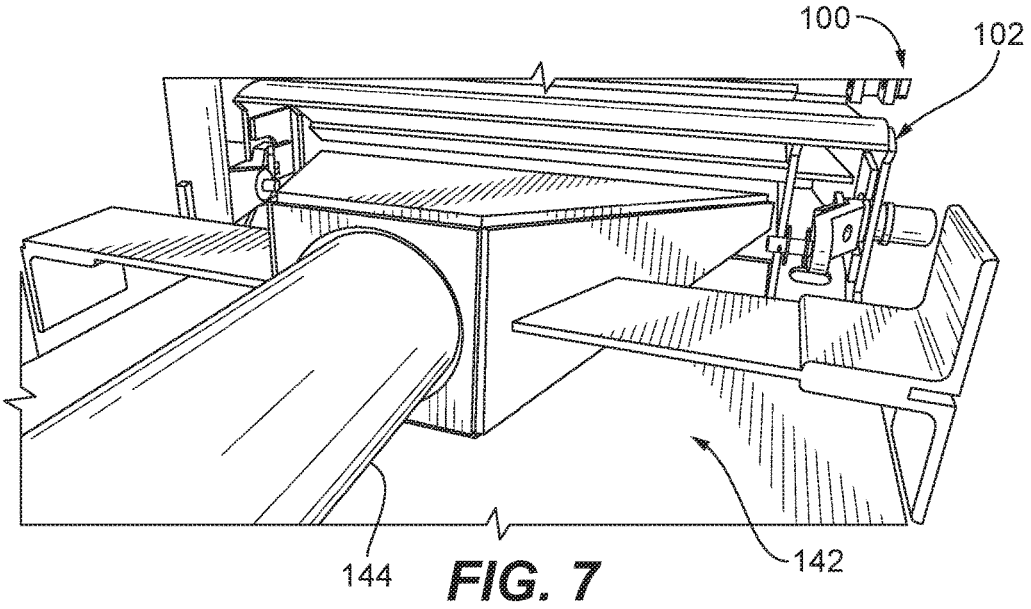
FIG. 7 is a schematic depiction of a back view of the wall-fired burner of FIG. 1, showing the fuel feed line as viewed from inside the windbox.

As shown in FIGS. 5-7 fuel tip 102 includes a gas spud 138 having a plurality of fuel orifices 140. Gas is delivered to gas spud 138 through gas feed pipe 144. The three tips 102, 104 and 106 are supplied with windbox air from a common windbox 142. On a coal fired under grate stoker, when the secondary fuel is natural gas, the burners can be located well above the grate elevation. Using traditional wall-fired burners in this situation tends to result in higher steam temperature and can limit steam generation capacity of the unit. By using tilting wall-fired gas burner 100 in accordance with the embodiments herein, the steam generation capacity can be increased over traditional wall-fired gas burners. Tilting wall-fired gas burner 100 design described herein is also applicable to other process furnaces for improved temperature control over performance with lower NOx emissions.

A method of controlling emissions in a steam generation plant includes issuing a stream of fuel from the fuel tip 102 of the wall-fired burner 100. The method includes adjusting a direction of the stream of fuel from the fuel tip 102 and airflow from the first and second air tips 104 and 106 to control at least one of NOx, CO and VOC emissions. Adjusting the direction of the fuel and of the airflow includes rotating the fuel tip 102, the first air tip 104 and the second air tip 106 about respective pivot axes. The method includes biasing at least one of the first and second air tips 104 and 106 with respect to fuel direction axis X of the fuel tip 102 to reduce emissions, e.g. pre-biasing first and/or second air tips 104 and 106 so that their direction axes D and A, respectively, are angled with respect to fuel direction axis X. This allows tuning of the gas flame to effect emissions and boiler performance. Angling air tips 104 and 106 away from the fuel tip 102 enhances air staging to reduce NOx. Angling 104 and 106 towards fuel tip 102 enhances air mixing to reduce CO and VOCs.

The methods and systems of the present disclosure, as described above and shown in the drawings, provide for wall-fired burners with superior properties including extended steam generation capacity and reduced maintenance requirements. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A wall-fired burner including:

a fuel tip defining a fuel direction axis and a fuel tip pivot axis perpendicular thereto;

a first air tip adjacent to the fuel tip, wherein the first air tip defines a first air direction axis and a first air tip pivot axis perpendicular thereto; and a second air tip adjacent to the fuel tip, opposite from the first air tip across the fuel tip, wherein the second air tip defines a second air direction axis and a second air tip pivot axis perpendicular thereto; and a mechanism operatively connecting the fuel tip, the first air tip and the second air tip for at least one of independent and/or joint movement of the fuel tip, the first air tip and the second air tip, wherein, when the fuel tip is in a horizontal position, the fuel direction axis is perpendicular to a burner wall.

2. A wall-fired burner as recited in claim 1, wherein the mechanism is a bar linkage that operatively connects the fuel tip, the first air tip and the second air tip for joint rotation about their respective pivot axes to adjust the direction of the respective direction axes.

3. A wall-fired burner as recited in claim 1, further comprising a drive arm having a first end operatively connected to at least one of the fuel tip, the first air tip or the second air tip to drive rotation of the fuel tip, the first air tip and the second air tip about the respective pivot axes.

4. A wall-fired burner as recited in claim 3, further comprising a rotating drive and an arm connector attached to the rotating drive, wherein the arm connector has a first end attached to the rotating drive and a second end attached to a second end of the drive arm.

5. A wall-fired burner as recited in claim 1, wherein the fuel tip is at least one of a coal or natural gas fuel tip.

6. A wall-fired burner as recited in claim 1, further comprising an igniter positioned adjacent to an exit of the fuel tip, between the exit of the fuel tip and an exit of one of the first or second air tips.

7. A wall-fired burner as recited in claim 1, further comprising a flame scanner positioned adjacent to an exit of the fuel tip.

8. A wall-fired burner as recited in claim 1, further comprising a first side wall and a second side wall, wherein the first and second side walls are opposite from one another across the fuel tip and the first and second air tips, wherein the fuel tip and the first and second air tips are rotatably connected to each of the side walls.

9. A method of controlling emissions in a steam generation plant, comprising:

issuing a stream of fuel from the fuel tip of the wall-fired burner as recited in claim 1; and adjusting a direction of the stream of fuel from the fuel tip and airflow the first and second air tips to control at least one of NOx, CO and VOC emissions.

10. A method as recited in claim 9, wherein adjusting the direction of the stream of fuel and of the airflow includes rotating the fuel tip, the first air tip and the second air tip about respective pivot axes.

11. A method as recited in claim 10, further comprising biasing at least one of the first and second air tips with respect to a fuel direction axis of the fuel tip to reduce emissions.

12. A wall-fired burner as recited in claim 1, wherein the fuel tip includes a gas spud having a plurality of fuel orifices.

* * * * *